US011015888B2

(12) United States Patent
Czok et al.

(10) Patent No.: US 11,015,888 B2
(45) Date of Patent: May 25, 2021

(54) DEVICE FOR LOADING A BARRELED WEAPON WITH AMMUNITION BODIES

(71) Applicant: KRAUSS-MAFFEI WEGMANN GMBH & CO. KG, Munich (DE)

(72) Inventors: Matthias Czok, Kassel (DE); Alexander Simon, Kassel (DE); Matthias Raczek, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 16/500,539

(22) PCT Filed: Apr. 3, 2018

(86) PCT No.: PCT/DE2018/100297
§ 371 (c)(1),
(2) Date: Oct. 3, 2019

(87) PCT Pub. No.: WO2018/184632
PCT Pub. Date: Oct. 11, 2018

(65) Prior Publication Data

US 2020/0326146 A1 Oct. 15, 2020

(30) Foreign Application Priority Data

Apr. 6, 2017 (DE) ..... 10 2017 107 442.2

(51) Int. Cl.
*F41A 9/42* (2006.01)

(52) U.S. Cl.
CPC ..... *F41A 9/42* (2013.01)

(58) Field of Classification Search
CPC ..... F41A 9/42
(Continued)

(56) References Cited

U.S. PATENT DOCUMENTS 3,584,532 A * 6/1971 Stoner ..... F41A 9/37 89/47
4,662,266 A * 5/1987 Lacoste ..... F41A 9/42 89/45

(Continued)

FOREIGN PATENT DOCUMENTS

DE 3825662 A1 2/1990
DE 3932130 A1 4/1991

(Continued)

OTHER PUBLICATIONS

PCT, European Patent Office (ISA/EP), International Search Report (with English Translation), International Application No. PCT/DE2018/100297, 5 pages (dated Jun. 12, 2018).

*Primary Examiner* — Samir Abdosh
(74) *Attorney, Agent, or Firm* — Thompson Hine LLP

(57) ABSTRACT

A device (1), and a barreled weapon (10) including the device, for loading the barreled weapon (10) with ammunition bodies (2), in particular with artillery projectiles, includes a rammer for moving an ammunition body (2) along a loading path (L) from a loading position outside of the loading chamber (12) into a rammed position in the loading chamber (12) of the barreled weapon (10), wherein a correction rammer (4) connected downstream of the rammer in the loading path is used to correct ramming errors if necessary. A method for loading the barreled weapon includes correcting ramming errors with a correction rammer (4) downstream of the rammer of the barreled weapon in the loading path of the weapon.

15 Claims, 2 Drawing Sheets

(58) Field of Classification Search
USPC ..... 89/47
See application file for complete search history.

(56) References Cited

U.S. PATENT DOCUMENTS 4,727,790 A * 3/1988 DeHaven ..... F41A 9/21 89/46
4,777,864 A * 10/1988 Siech ..... F41A 9/20 700/15
4,957,028 A * 9/1990 Lieberum ..... F41A 9/42 89/47
5,111,731 A * 5/1992 Grabner ..... F41A 9/42 89/46
5,196,643 A * 3/1993 Jorg ..... F41A 9/16 89/46
5,233,125 A * 8/1993 Bouver ..... F41A 9/76 89/36.13
5,440,966 A * 8/1995 Tellander ..... F41A 9/13 89/46
5,563,363 A * 10/1996 Soulaigre ..... F41A 9/14 89/46
5,773,747 A * 6/1998 Tellander ..... F41A 9/43 89/45
5,831,201 A * 11/1998 Andersson ..... F41A 9/42 89/45
6,161,461 A * 12/2000 Hupfeld ..... F42B 8/12 89/29
6,443,045 B1 * 9/2002 Kohltsedt ..... F41A 9/44 89/47
6,457,397 B1 * 10/2002 Guesnet ..... F41A 9/14 89/46
7,836,812 B2 * 11/2010 Spork ..... F41A 9/375 89/45

FOREIGN PATENT DOCUMENTS

DE 19807976 A1 8/1999
DE 102012108832 A1 3/2014
DE 102012108932 A1 3/2014
EP 0450373 A1 10/1991
EP 0352584 B1 3/1993
EP 1041355 B1 5/2005
EP 1736726 A1 12/2006

* cited by examiner

DEVICE FOR LOADING A BARRELED WEAPON WITH AMMUNITION BODIES

TECHNICAL FIELD

The invention relates to a device for loading a barreled weapon with ammunition bodies, in particular with artillery projectiles, with a rammer for moving an ammunition body from a loading position outside the loading chamber along a loading path into a rammed position in the loading chamber of the barreled weapon. Furthermore, the invention relates to a corresponding method for loading a barreled weapon with ammunition bodies as well as a barreled weapon with such a device.

BACKGROUND

In the military sector, barreled weapons of different calibers are used, from rather small-caliber machine guns to large-caliber artillery weapons. Before firing, the barreled weapons are loaded with one or more ammunition bodies, using split ammunition, especially for large-caliber barreled weapons, such as artillery guns. In the case of split ammunition, the ammunition bodies are, on the one hand, the actual projectiles, such as artillery projectiles, and on the other hand, the propellants used to accelerate the projectiles. The projectiles and propellants are usually loaded one after the other in separate working steps.

First, the projectile is moved from a loading position outside the loading chamber of the barreled weapon along a loading path to a rammed position in the loading chamber of the barreled weapon. In the second step, the propellants are also transported from a loading position outside the loading chamber of the barreled weapon along the loading path to the loading chamber of the barreled weapon. Usually, loading the projectile is carried out with a first rammer and loading the propellant is carried out with a separate second rammer.

Automatic ramming devices, such as those known from EP 0 352 584 B1 or EP 1 041 355 B1, are often used to transport the projectile to the rammed position thereof. However, during ramming, in very unfavorable circumstances, errors may occur in certain situations which prevent the ammunition body from being held in the loading chamber in the rammed position. This is the case, for example, if a provided driving band of the projectile does not deform or is not sufficiently deformed when inserting it into the loading chamber of the barreled weapon. In such situations, it may occur, in particular with greater elevation of the weapon barrel, that the projectile is not held in its rammed position by the clamping force of the driving band but moves back against to the ramming direction under the influence of gravity.

For safety reasons, the corresponding barreled weapons therefore comprise devices known as return latches, which prevent the ammunition body from completely slipping out of the barreled weapon, as this has a significant associated risk to the operators of the weapon.

Even if the return latch prevents complete slipping out of an incorrectly rammed projectile, it is necessary for the operator to intervene manually in order to correct the ramming error. For this purpose, it is first necessary that he moves from his operating position to the loading end of the barreled weapon. There, the operator must manually operate the return latch and remove the ammunition body, which sometimes has a considerable weight, by hand from the loading chamber of the weapon, in order to be able to restart the automatic ramming device.

This is associated with great effort, a considerable load and an increased risk of injury, for example by crushing the operator. In addition, the operator has to leave his operating position, which is often protected against military threats, for example inside an armored vehicle cabin, for a certain period of time to correct a ramming error. Above all, during ongoing combat missions in unsecured areas, in doing so the operator is exposed to a significant risk of danger without protection for the duration of the correction.

SUMMARY

It is therefore the object of the present invention to specify a device and a method for loading a barreled weapon and a barreled weapon with such a device, which is characterized by a reduced risk to the operator.

In the case of a device of the type mentioned above, the problem is solved by a correction rammer downstream of the rammer in the loading path for correcting of ramming errors as required.

By using the correction rammer downstream of the rammer, ramming errors can be corrected automatically without manual operator intervention. If, in very unfavorable circumstances, a ramming error occurs in a certain situation, the operator no longer has to leave the protected area of the weapon system to correct this ramming error and thereby expose himself to an increased risk of danger. Rather, the correction of the ramming error can be carried out from the protected operating conditions, for example by remote control or fully automatically.

With an advantageous embodiment of the device, it is provided that the correction rammer is at least partially movable into the barrel of the weapon. In this way, the correction rammer can correct a ramming error without having to completely take the corresponding ammunition body from the barrel of the weapon.

It is advantageous if the correction rammer is movable along the loading path at multiple speed levels, in particular two speed levels. A slow speed level can be used to approach the correction device to the ammunition body, which prevents damage to the ammunition body when contacting the correction rammer. A faster speed level can be used to accelerate the ammunition body towards the rammed position when there is contact between the correction rammer and the ammunition body. The ammunition body can thus be accelerated to a speed at which it has kinetic energy, which is used for ramming and for deforming the driving band. Advantageously, the correction rammer decelerates as soon as the ammunition body has sufficient kinetic energy. The deceleration can take place over a comparatively short distance compared to the entire loading path, without decelerating the ammunition body in doing so. Thus, the ammunition body can continue along the further loading path to the rammed position independently of the correction rammer and the correction rammer can already be moved out of the barrel of the weapon.

A further embodiment provides that the correction rammer is a guided rammer, in particular a telescopic rammer. The use of chain rammers and in particular chain rammers with a stiff rammer chain for insertion into the loading chamber of the weapon or the use of elbow rammers is also conceivable. Driven rammers have proved to be very reliable, as they are in contact with the ammunition body during the ramming and can drive it along the loading path to its scheduled position. In particular, telescopic rammers enable a simple and reliable construction. Chain rammers provide an especially space-saving solution. Particularly preferably, the rammer can be pneumatically operated. To this end, it has proved particularly advantageous if the rammer can be connected to an air pressure supply, for example to the already provided air pressure system of a military vehicle, such as an armored howitzer.

A constructively advantageous design further provides that the correction rammer is movable transversely to the loading path. In this way, the correction rammer can, if necessary, be transferred from a standby position in which it is stored in a space-saving manner into the loading path of the barreled weapon in order to correct an occurring ramming error from there. This transverse movement uses the space parallel to the loading path without increasing the space behind the barreled weapon that is needed for loading, which is limited in any case.

According to one embodiment, it is proposed that the correction rammer is disposed on a loading arm that is rotatably supported around the elevation axis of the barreled weapon. With such a loading arm, the ammunition bodies are transferred from a magazine or an ammunition feeder to the loading position, from which the rammer transfers the ammunition bodies along the loading path to the rammed position. The position of the loading path in the chamber depends on the elevation of the barreled weapon. Due to the rotatable mounting of the loading arm around the elevation axis of the barreled weapon, the loading arm can always be rotated into the same relative position in the loading path of the barreled weapon. By disposing the correction rammer on the rotatably mounted loading arm, the required space can be reduced.

Furthermore, it may be advantageous if the correction rammer is disposed on the rammer. In this way, a common device for movement and/or alignment of the rammer in the loading path can also be used for the correction rammer. This can result in a compact design. In particular, the rammer may be disposed on the loading arm.

A further embodiment provides for a return latch, which prevents the ammunition bodies from slipping out of the barreled weapon in the event of a ramming error. In this way, the ammunition body can be held in the barreled weapon and easily rammed again by the correction rammer. The inner wall of the barreled weapon can serve as a lateral guide of the ammunition body. Also, damage to the ammunition body and/or the loading device due to the ammunition body completely slipping out of the barreled weapon can thus be counteracted.

Preferably, the return latch is arranged at the loading-side end of the barreled weapon. An incorrectly rammed ammunition body can thus slip to the loading-side end of the barreled weapon without falling out of the barreled weapon.

According to an advantageous embodiment, a ramming quality sensor is provided for detecting the ramming quality of a rammed ammunition body and/or for the detection of ramming errors. The measured values of the sensor allow the operator to assess the ramming quality of the ammunition body without having to leave his protected operating position. The ramming quality sensor can measure at least one quantity that allows a conclusion to be drawn regarding the ramming quality of the ammunition body, such as the distance from the ammunition body, a resistance between electrical contacts and/or a pressure on the inner wall of the barreled weapon. The ramming quality sensor can also automatically detect an incorrectly rammed ammunition body. The operator can thus detect a ramming error from his protected operating position and can actuate the automatically operating correction rammer by means of a remote control device. It is also possible that the correction rammer is triggered fully automatically for detecting a ramming error without the intervention of the operator.

Preferably, the ramming quality sensor is embodied as a distance sensor. In this way, the ramming quality can be determined in a particularly simple way on the basis of the distance between the ramming quality sensor and the ammunition body. This distance measurement is particularly preferably carried out along the loading path.

Furthermore, it is advantageous if the ramming quality sensor is disposed on a loading arm. By turning the loading arm when loading the barreled weapon, the ramming quality sensor is placed in its measuring position during each loading process and can perform the required measurement during the loading process without extending the ramming time.

It has also proven to be constructively advantageous if the ramming quality sensor is disposed on a propellant rammer. Since the propellant rammer is brought into the loading path of the barreled weapon after the completion of ramming the projectile, the ramming quality sensor can perform the required measurement before the propellant is then moved to the area behind the rammed projectile in a next step.

A further embodiment provides that the rammer and/or the correction rammer and/or the ramming quality sensor are arranged in the manner of a revolver drum. In this way, a particularly space-saving design can be realized.

Furthermore, it is advantageous to provide a means of measuring the distance between the correction rammer and the ammunition body. In this way, the distance can be detected during the approach of the correction rammer to the ammunition body. This measurement can be used to control the approach behavior of the correction rammer. It is conceivable to approach at different speed levels, for example first at a fast speed level, with which time can be saved during the approach, and at a slower speed level below a defined distance from the ammunition body, at which the correction rammer is brought into contact with the ammunition body slowly and without damaging the ammunition body. Preferably, a ramming quality sensor in the form of a distance sensor can be used as a measurement means.

A development of the invention provides a force sensor for determining the force acting on the correction rammer. In this way, it can be detected when the correction rammer comes into contact with the ammunition body. Depending on this, the correction rammer can be controlled, for example the speed or acceleration thereof can be changed. Furthermore, the correction rammer can be used on the basis of the measured values of the force sensor to press the ammunition body into the loading chamber of the barreled weapon with a defined force. As a result, for example, a driving band, the clamping force of which holds the ammunition body in the rammed position, can be deformed.

In the case of a barreled weapon of the type mentioned above, the problem is solved by a device for loading the barreled weapon with one or more of the preceding characteristics. This results in the advantages already explained in connection with the device.

In the design of the barreled weapon, it is further proposed that a return latch comprises the ramming quality sensor for detecting the ramming quality of a rammed ammunition body and/or for detecting ramming errors. In this way, the ramming quality sensor can be attached to the weapon in a very space-saving manner, as no mount outside the barrel weapon is required for the ramming quality sensor. Due to the contact between the return latch and an incorrectly rammed ammunition body, contact sensors, such as pressure sensors or contact voltage sensors, can also be used in a simple way to detect ramming errors. Also, the ramming quality sensor is permanently located within the loading path of the barreled weapon and does not have to be placed in the loading path to determine the ramming quality. This can reduce the time between ramming and the detection of the ramming quality.

In addition, in order to achieve the above-mentioned object with a method for loading a barreled weapon with ammunition bodies, in particular with artillery projectiles, with a rammer for moving an ammunition body from a loading position outside the loading chamber along a loading path to a rammed position in the loading chamber of the barrel weapon, it is proposed that ramming errors are corrected as required with a correction rammer downstream of the rammer in the loading path. With such a method, the advantages described in connection with the device for loading a barreled weapon also arise.

BRIEF DESCRIPTION OF THE DRAWINGS

Further details and advantages of a device according to the invention, a corresponding barreled weapon as well as the associated method are explained below with the assistance of the attached drawings of an exemplary embodiment. In each figure in a schematic view.

DETAILED DESCRIPTION

Figure 1:
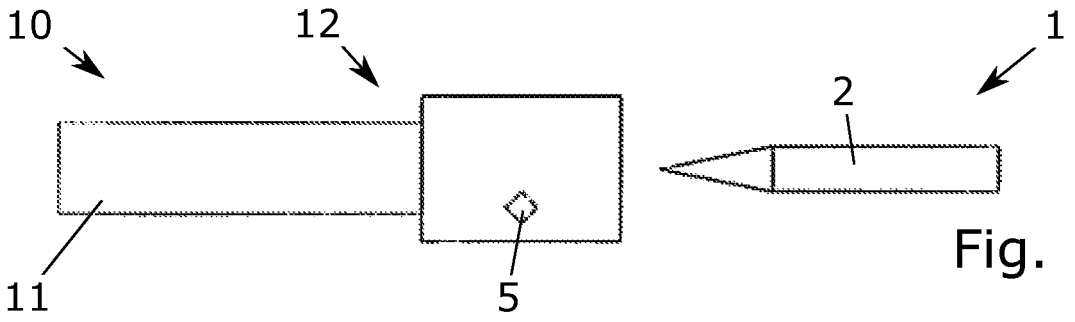
FIG. 1 shows a barreled weapon according to the invention with an ammunition body in the loading position.

In the military field, large-caliber missiles in the form of guns, artillery weapons, howitzers, etc. are often operated with split ammunition, in which the projectile and the propellant are present as separate ammunition bodies 2.

In contrast to cartridge ammunition, the loading of the barreled weapon 10 is therefore carried out in two separate steps. In a first step, the projectile is transferred to the loading chamber 12 of the weapon, after which the projectile is located in a rammed position in the loading chamber of the weapon 10. In this position, the projectile is held in a defined position in the loading chamber 12 of the weapon 10, wherein a free space remains behind the rammed projectile on the load side, into which the propellant is introduced in a second step. These two processes usually run separately from each other and the type and quantity of the propellant can influence the acceleration of the projectile according to a previously defined fire control solution.

To ram the ammunition body 2, which is in the form of a projectile, automated ramming devices 1 are often used.

FIG. 1 shows schematically the loading-side end of a barreled weapon 10 according to the invention, before the weapon 10 is loaded with an ammunition body 1. For example, the barreled weapon 10 may be an artillery weapon, the weapon of a battle tank, or another barreled weapon. As an essential component, the barreled weapon 10 comprises a barrel 11, which can be oriented in azimuth and elevation, from which the ammunition body 2 can be fired and which is shown in the figures only in a shortened form. Inside the loading-side region of the barrel 11 is the loading chamber 12 of the barreled weapon 10, in which the ammunition body 2 can be rammed pressure-tight in a clamping manner.

When loading the barreled weapon 10, an ammunition body 2 is introduced into the loading chamber 12 by a device 1 for loading the barreled weapon 10 and thus into the barrel 11 of the barreled weapon 10. For this purpose, the ammunition body 2 is first positioned in a loading position outside the loading chamber 12. This positioning can be carried out, for example, by a loading arm that is not shown that is pivotally linked around the elevation axis of the barreled weapon 10. By a pivotal movement of the loading arm, an ammunition body 2 provided by an ammunition feeder or a magazine is automatically brought into the loading position that is aligned with the barrel's bore axis, regardless of the elevation of the barreled weapon 10.

From the loading position, a rammer that is not shown in the figures transfers the ammunition body 2 along a loading path L into the loading chamber 12. For reasons of an overall view, the rammer is not shown, but usually the rammer is part of the device 1.

Various types of rammers can also be used as the rammer, for example guided rammers, with which the ammunition body 2 is pushed into the rammed position thereof by a sliding rammer element or a rammer chain. With guided rammers, design-related ramming errors are rather unlikely, but they have the disadvantage of comparatively long loading times, since the sliding rammer element or the rammer chain must be moved out of the barrel 10 again after ramming before another ammunition body 2 can only then be rammed.

Significantly shorter loading times can be achieved with so-called free-flying rammers. Such free-flying rammers accelerate the ammunition body 2 outside the barreled weapon 10 to a sufficiently high ramming speed, so that the ammunition body 2 enters the loading chamber 12 of the barreled weapon 10 virtually in free flight and thus reaches the rammed position. Since the free-flying rammer does not move into the barrel 11 of the barreled weapon 10 and thus does not have to be moved out of it again, favorable loading times result. The occurrence of ramming errors is also very rare with such rammers, but somewhat more likely than with guided rammers.

In the event of a ramming error, the ammunition body 2 does not remain in the rammed position after the automatically running rammer process but slips back along the loading path L towards the loading end of the barreled weapon 10.

Figure 2:
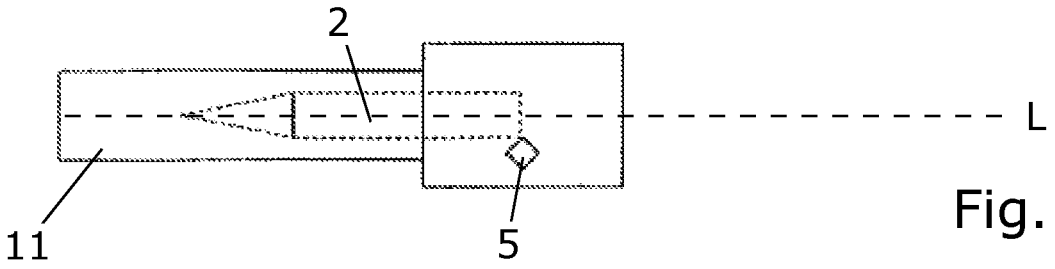
FIGS. 2-9 show multiple views of the barreled weapon from FIG. 1 to illustrate the processes when a ramming error occurs.

Such a situation is illustrated in FIG. 2. As can be seen in particular, the ammunition body 2 that is sliding back is prevented by a return latch 5 from completely sliding out of the barreled weapon 10. In this way, the danger to the operator of a sliding ammunition body 2 is prevented, but the ammunition body 2 must be rammed again.

Figure 3:
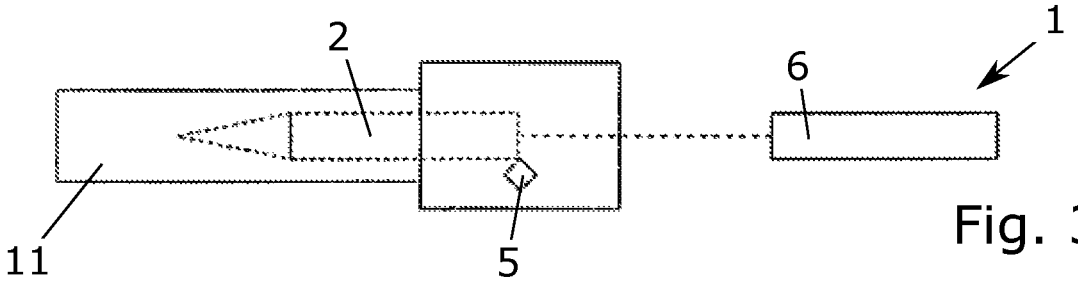

In order to be able to correct the ramming error automatically, it is first necessary that the incorrectly rammed ammunition body 2 is also recognized as such. FIG. 3 shows a ramming quality sensor placed in the loading path L for this purpose. Said ramming quality sensor 6 is embodied here as a distance meter and is for example in the form of a laser distance meter or an ultrasonic distance meter and measures the distance from the ammunition body 2 as a measure of the ramming quality. Said distance is used to determine whether a ramming error occurred when ramming the ammunition body 2, as is the case in the example shown. The ramming quality sensor 6 can also be part of the device 1.

In order to bring the ramming quality sensor 6 into the loading path L, the sensor may be linked to the device 1 or to the barreled weapon 10. Likewise, it is also conceivable to dispose the ramming quality sensor 6 on the loading arm, the rammer, a propellant rammer that is not shown and/or the correction rammer 4 to reduce the number of components required for the movements. It is precisely disposal on the rammer or on the correction rammer 4 that is advantageous here, since the ramming quality sensor 6 is already located in the loading path L after the ramming by the rammer or the correction rammer 4 and does not have to be brought into the loading path L. Furthermore, it is also conceivable to dispose the ramming quality sensor 6 not outside, but within the barreled weapon 10, in particular in or on the return latch 5. Thus for example, the ramming quality sensor 6 does not have to be first brought into the loading path L and there would be other possibilities available for detection of the ramming quality, such as contact measurements or inductive measuring methods for detecting the location of the ammunition body 2.

Figure 4:
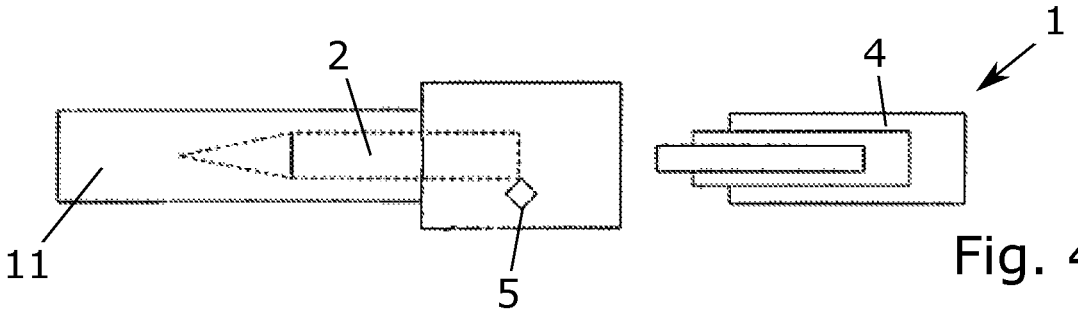

In the next step, after a ramming error has been detected and the ramming quality sensor 6 is removed from the loading path L, a correction rammer 4 is positioned in the loading path L, as shown in FIG. 4. The positioning of the correction rammer 4 in the loading path L that is not shown is preferably carried out transversely to the loading path L. Thus, the spatial region parallel to the loading path L is used in order to store the correction rammer 4 in its standby position without further restricting the limited area behind the barreled weapon 10. In a similar way as with the ramming quality sensor 6, the correction rammer 4 can also be disposed on the loading arm, on the ramming quality sensor 6 and/or on the rammer.

The correction rammer 4 can be a free-flying rammer, a guided rammer or a combination of both. In the exemplary embodiment shown, the correction rammer 4 is in the form of a telescopically extendable rammer as a type of loading slider. Equally conceivable are other types of rammers, such as chain rammers.

Figure 5:
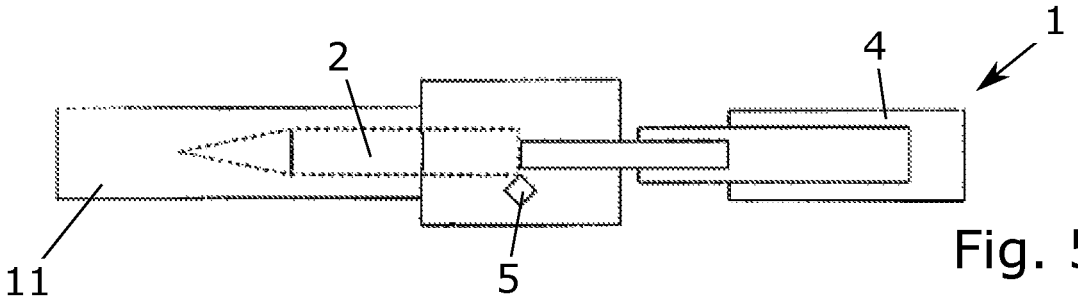
Figure 6:
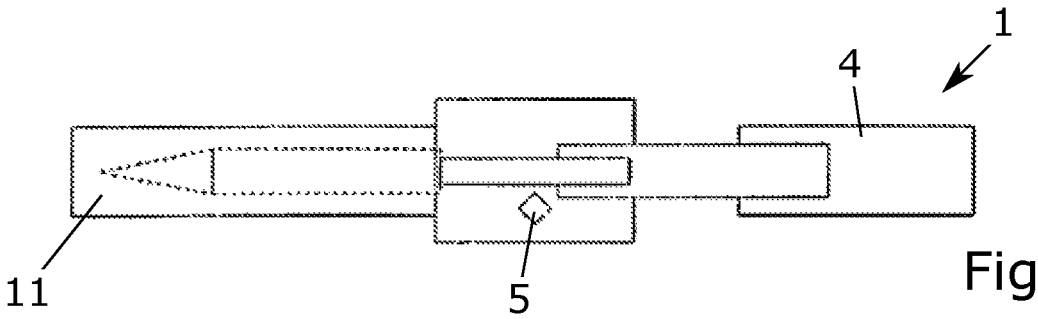

To correct the ramming error, the correction rammer 4 is first moved along the loading path L up to the contact shown in FIG. 5 with the ammunition body 2. This approach movement of the correction rammer 4 to the ammunition body 2 takes place at different speed levels of the correction rammer 4. During the approach movement a measurement means that is not shown registers the distance between the correction rammer 4 and the ammunition body 2. The speed level of the correction rammer 4 is controlled using the distance. A first, preferably larger part of the feeding movement takes place in a fast speed stage. In this way, the required approach time is kept short. A second part of the approach movement is carried out at a slow speed level until the correction rammer 4 contacts the ammunition body 2. In this way, damage to the ammunition body 2 by the correction rammer 4 is avoided.

A force sensor that is also not shown determines the force acting on the correction rammer 4. For this purpose, the force sensor can be disposed between components in the force flow or at the barrel-side end of the correction rammer 4. The contact between the correction rammer 4 and the ammunition body 2 is detected using the measured force. In addition, when ramming the ammunition body 2 into the rammed position, a predefined force limit is exceeded, for example when the driving band that is not shown is deformed. Thus, when using a guided rammer as a correction rammer 4, the force sensor can be used to determine the force that occurs when the ammunition body 2 has correctly taken up its rammed position.

After the correction rammer 4 has come into contact with the ammunition body 2, the correction rammer 4 accelerates the ammunition body 2 along the loading path L away from the loading end of the barreled weapon. Preferably, this acceleration is carried out at a faster speed level of the correction rammer 4, which is in particular faster than the fast speed level of the approach movement. In this way, the time required for the ramming process is further reduced.

Figure 7:
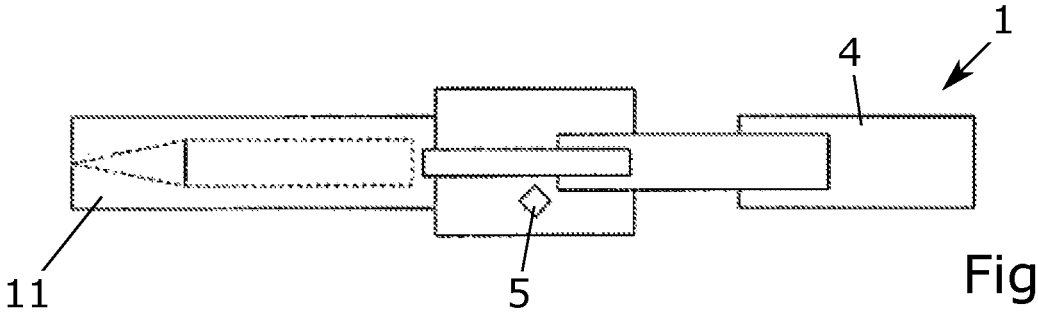

In the exemplary embodiment shown, the acceleration of the ammunition body 2 is carried out until the correction rammer 4 has reached a position shown in FIG. 7 on the rammer side before the rammed position. At this position, the telescopically extendable correction rammer 4 shown decelerates, reverses its direction of movement and begins to concertina towards the loading-side end of the barreled weapon 10. Due to the inertia thereof, the accelerated ammunition body 2 continues the movement thereof independently of the correction rammer 4 in a virtually free flying manner until reaching the rammed position.

Figure 8:
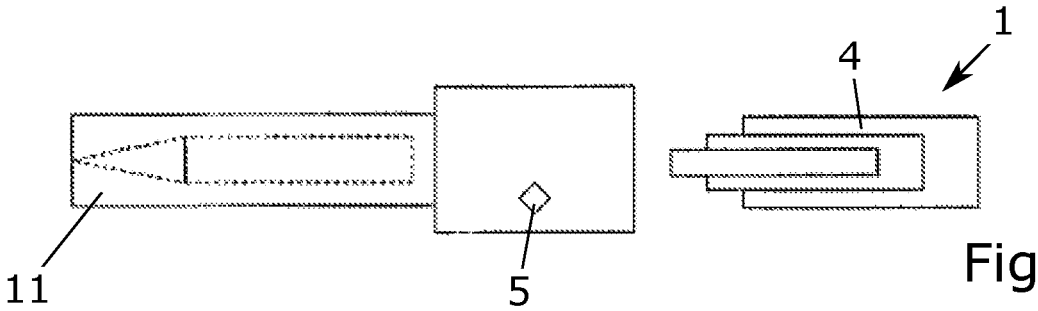

While the ammunition body 2 is travelling along the remaining section of the loading path L to the rammed position, the correction rammer 4 is already moving back along the loading path L to its initial position. Thus, the correction rammer 4 takes up the starting position shown in FIG. 4 and FIG. 8 again in a time-saving way, since moving the correction rammer 4 out of the barrel 11 of the barreled weapon 10 takes place temporally in parallel with the ramming movement of the ammunition body 2.

Figure 9:
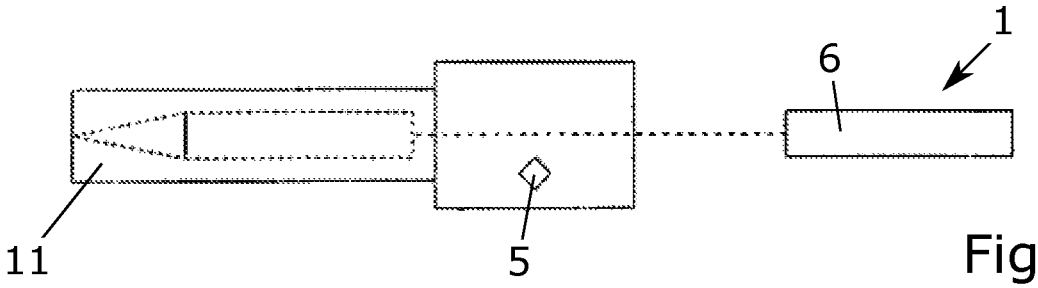

In the next step, the correction rammer 4 is removed from the loading path L and the ramming quality sensor 6 is reintroduced into the loading path L as described above. As the representation in FIG. 9 shows, the ramming quality sensor 6 again determines the ramming quality of the ammunition body 2. If a correctly rammed ammunition body 2 is detected in the rammed position, as shown in FIG. 9, the operation of the barreled weapon 10 is continued in the standard manner. Thus, the ammunition body 2 can be fired or further ammunition bodies 2 can be loaded into the barreled weapon 10. If, on the other hand, the ramming quality sensor 6 again detects a ramming error, the correction ramming is carried out again from the step shown in FIG. 4.

By using the device described above, the risk to the operator can be significantly reduced, since an automatic correction of a ramming error without the manual intervention of the operator is enabled. For this purpose, the operator therefore no longer has to leave his protected operating position and therefore does not expose himself to an increased risk of danger.

REFERENCE CHARACTER LIST

1 Device
2 Ammunition body
4 Correction rammer
5 Return latch
6 Ramming quality sensor
10 Barreled weapon
11 Barrel
12 Loading chamber
L Loading path

What is claimed is:

1. A device for loading a barreled weapon (10) with ammunition bodies (2), in particular with artillery projectiles, the device comprising:

a rammer for moving an ammunition body (2) from a loading position outside a loading chamber (12) of the barreled weapon (10) along a loading path (L) into a rammed position in the loading chamber (12) of the barreled weapon (10); and a correction rammer (4) downstream of the rammer in the loading path for correcting ramming errors as required.

2. The device as claimed in claim 1, wherein the correction rammer (4) is movable along the loading path (L) at multiple speed levels, in particular at two speed levels.

3. The device as claimed in claim 1, wherein the correction rammer (4) is a guided rammer, in particular a telescopic rammer.

4. The device as claimed in claim 1, wherein the correction rammer (4) is movable transversely to the loading path (L).

5. The device as claimed in claim 1, wherein the correction rammer (4) is disposed on a loading arm that is rotatably supported around an elevation axis of the barreled weapon.

6. The device as claimed in claim 1, further comprising a return latch (5), which prevents ammunition bodies from slipping out of the barrel weapon (10) in the event of a ramming error.

7. The device as claimed in claim 6, wherein the return latch (5) is disposed at a loading-side end of the barreled weapon (10).

8. The device as claimed in claim 1, further comprising a ramming quality sensor (6) for detecting a ramming quality of a rammed ammunition body (2) and/or for detecting ramming errors in the barreled weapon.

9. The device as claimed in claim 8, wherein the ramming quality sensor (6) is embodied as a distance sensor.

10. The device as claimed in claim 8, wherein the ramming quality sensor (6) is disposed on a propellant rammer.

11. The device as claimed in claim 8, wherein the rammer and/or the correction rammer (4) and/or the ramming quality sensor (6) are disposed in the manner of a revolver drum.

12. The device as claimed in claim 1, further comprising a force sensor for determining the force acting on the correction rammer (4).

13. A barreled weapon (10) for firing ammunition, in particular artillery rounds, the weapon comprising:

a device (1) for loading the barreled weapon (10) as claimed in claim 1.

14. The barreled weapon as claimed in claim 13, further comprising a return latch (5) that includes a ramming quality sensor (6) for detecting a ramming quality of a rammed ammunition body (2) and/or for detecting ramming errors.

15. A method for loading a barreled weapon (10) with ammunition bodies (2), in particular with artillery projectiles, with a rammer for moving an ammunition body (2) from a loading position outside a loading chamber (12) along a loading path (L) to a rammed position in the loading chamber (12) of the barreled weapon (10), the method comprising:

correcting ramming errors as required with a correction rammer (4) downstream of the rammer in the loading path (L).

* * * * *